US009457216B2

(12) United States Patent
Lagree

(10) Patent No.: US 9,457,216 B2
(45) Date of Patent: Oct. 4, 2016

(54) SELF-STANDING WEIGHTED POLE SYSTEM

(71) Applicant: SPX Fitness, Inc., Burbank, CA (US)

(72) Inventor: Sebastien Anthony Louis Lagree, West Hollywood, CA (US)

(73) Assignee: SPX Fitness, Inc., Burbank, CA (US)

( * ) Notice: Subject to any disclaimer, the term of this patent is extended or adjusted under 35 U.S.C. 154(b) by 0 days.

(21) Appl. No.: 14/536,986

(22) Filed: Nov. 10, 2014

(65) Prior Publication Data

US 2015/0141204 A1 May 21, 2015

Related U.S. Application Data

(60) Provisional application No. 61/905,513, filed on Nov. 18, 2013.

(51) Int. Cl.

| | |
|---|---|
| ***A63B 21/00*** | (2006.01) |
| ***A63B 21/072*** | (2006.01) |
| *A63B 21/06* | (2006.01) |
| *A63B 22/00* | (2006.01) |

(52) U.S. Cl.

CPC ..... *A63B 21/0004* (2013.01); *A63B 21/072* (2013.01); *A63B 21/0615* (2013.01); *A63B 22/0089* (2013.01)

(58) Field of Classification Search

CPC ..... A63B 9/00; A63B 2244/225; A63B 2210/50; A63B 2071/024; A63B 2071/026; A63B 21/1681; A63B 25/00; A63B 2225/09; A63B 2225/093; A63B 26/00; A63B 5/06; A63B 15/00; A63B 15/02; A63B 67/086; G10G 7/00

USPC ..... 482/33, 83

See application file for complete search history.

(56) References Cited

U.S. PATENT DOCUMENTS

| | | | | | |
|---|---|---|---|---|---|
| 1,085,505 | A * | 1/1914 | Stafford | E02D 3/068 | 16/430 |
| 2,113,826 | A * | 4/1938 | Carpenter | A63B 5/06 | 473/323 |
| 2,723,855 | A * | 11/1955 | McKee | A63B 25/00 | 482/33 |
| 2,909,371 | A * | 10/1959 | Alcover | A63B 21/1492 | 482/148 |
| 2,997,300 | A * | 8/1961 | House | A63B 25/08 | 116/DIG. 24 |
| 3,081,999 | A * | 3/1963 | Harris | A63B 67/08 | 273/449 |
| 3,228,683 | A * | 1/1966 | Leteff | A63B 23/03575 | 482/148 |
| 3,491,999 | A * | 1/1970 | Lindler | A63B 5/06 | 156/187 |
| 3,782,721 | A * | 1/1974 | Passera | A63B 21/012 | 482/117 |
| 3,923,302 | A * | 12/1975 | Boggild | A63B 9/00 | 482/33 |
| 4,139,193 | A * | 2/1979 | Felber | A63B 69/004 | 482/90 |

(Continued)

OTHER PUBLICATIONS

JFit Deluxe Doorway Pull-up Bar (Amazon.com public available sell date 2012) https://www.amazon.com/fit-Deluxe-Doorway-Pull-Up-Bar/dp/BOOD9Q7ZVY/ref=sr_1_1?ie=UTF8&qid=1465605934&sr=8-1&keywords=j+fit+deluxe+doorway+pull-up+bar.*

*Primary Examiner* — Loan H Thanh
*Assistant Examiner* — Andrew S Lo
(74) *Attorney, Agent, or Firm* — Neustel Law Offices; Michael S. Neustel

(57) ABSTRACT

A self-standing weighted pole system for providing convenient stabilization and additional weight for an exerciser. The self-standing weighted pole system generally includes an elongated pole having a lower end and an upper end, and a base attached to the lower end of the pole. The base includes an outer end that is broader than the pole to support the pole in a substantially vertically orientated self-standing manner.

26 Claims, 12 Drawing Sheets

(56) References Cited

U.S. PATENT DOCUMENTS 4,145,044 A * 3/1979 Wilson ..... A63B 63/083 248/188.1
4,383,387 A * 5/1983 Puskar ..... A63B 67/086 446/236
4,830,371 A * 5/1989 Lay ..... A63B 69/0091 248/516
4,895,377 A * 1/1990 Arbor ..... A63B 67/086 446/240
5,039,108 A * 8/1991 Arbor ..... A63B 67/086 473/514
5,536,229 A * 7/1996 Albergo ..... A63B 21/00047 482/148
5,538,364 A * 7/1996 Huntsman ..... E21D 15/54 405/288
5,628,713 A * 5/1997 Wilkinson ..... A45B 3/00 482/51
5,759,139 A * 6/1998 Wright ..... A63B 23/03533 482/121
5,839,996 A * 11/1998 Gooding ..... A63B 21/072 482/106
5,897,469 A * 4/1999 Yalch ..... A63B 15/00 473/256
6,045,462 A * 4/2000 Mourek ..... A63B 69/0075 473/417
6,398,671 B1 * 6/2002 Rios ..... A63B 69/0075 273/317.6
6,616,554 B2 * 9/2003 Liao ..... A63B 69/0075 473/417
7,090,626 B1 * 8/2006 Miller ..... A63B 21/1438 482/139
7,108,636 B1 * 9/2006 Garcia ..... A63B 21/1627 482/139
8,029,389 B2 * 10/2011 Chiu ..... A63B 69/0002 473/417
8,167,152 B1 * 5/2012 Gatti ..... E04B 2/7435 211/187
2003/0013586 A1 * 1/2003 Rothschild ..... A63B 23/12 482/117
2006/0160463 A1 * 7/2006 Orr ..... A63B 15/00 446/236
2008/0146423 A1 * 6/2008 Ammon ..... A63B 9/00 482/131
2011/0190098 A1 * 8/2011 Griswold ..... A63B 1/00 482/40
2011/0218058 A1 * 9/2011 Gangelhoff ..... A63B 69/00 473/417
2013/0210554 A1 * 8/2013 Carlson ..... A63B 69/0002 473/417

* cited by examiner

SELF-STANDING WEIGHTED POLE SYSTEM

CROSS REFERENCE TO RELATED APPLICATIONS

I hereby claim benefit under Title 35, United States Code, Section 119(e) of U.S. provisional patent application Ser. No. 61/905,513 filed Nov. 18, 2013. The 61/905,513 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an exercise support pole and more specifically it relates to a self-standing weighted pole system for providing convenient stabilization and additional weight for an exerciser.

2. Description of the Related Art

Any discussion of the related art throughout the specification should in no way be considered as an admission that such related art is widely known or forms part of common general knowledge in the field.

Poles for use during exercises have been around for years. One example of an exercise pole is an elongated metal rod used by exercisers to rotate their body in a reciprocating manner with the metal rod on their shoulders. The problem with conventional poles used for exercises is that they are not self-standing thereby requiring the exerciser to position the pole on a storage rack or leave the pole lying on the floor which can be dangerous. In addition, conventional exercise poles have a consistent diameter from the middle of the pole to the opposing ends which is typically two inches or less making them unstable for a user to use for support during an exercise and almost impossible to self-stand.

Because of the inherent problems with the related art, there is a need for a new and improved self-standing weighted pole system for providing convenient stabilization and additional weight for an exerciser.

BRIEF SUMMARY OF THE INVENTION

The invention generally relates to an exercise support pole which includes an elongated pole having a lower end and an upper end, and a base attached to the lower end of the pole. The base includes an outer end that is broader than the pole to support the pole in a substantially vertically orientated self-standing manner.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
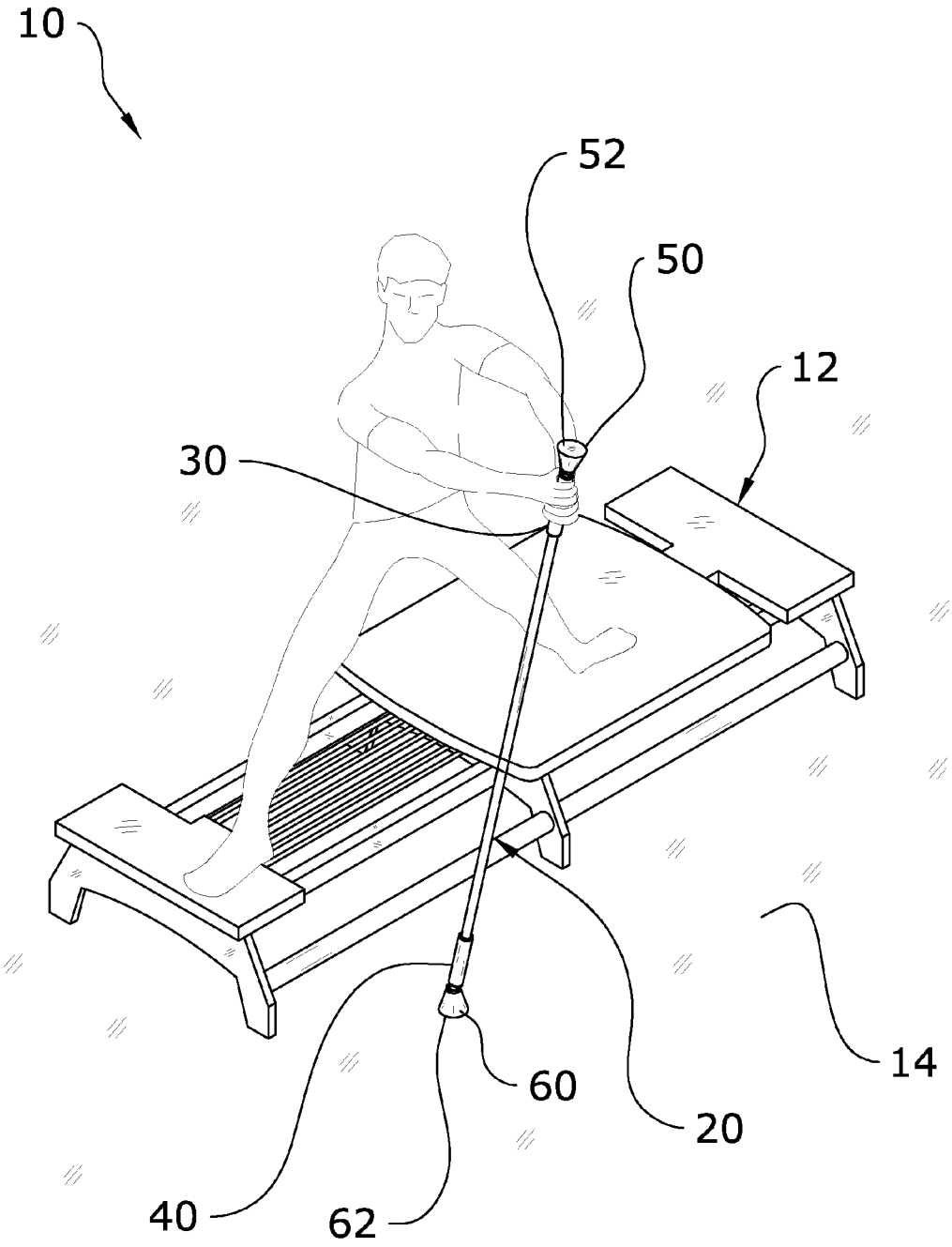
FIG. 1 is an upper perspective view of the present invention in use by a user standing on an exercise machine.

Turning now descriptively to the drawings, in which similar reference characters denote similar elements throughout the several views, FIGS. 1 through 13 illustrate a self-standing weighted pole system 10, which comprises an elongated pole 20 having a lower end and an upper end, and a base attached to the lower end of the pole 20. The base includes an outer end that is broader than the pole 20 to support the pole 20 in a substantially vertically orientated self-standing manner. The self-standing weighted pole system 10 is designed to be self-supporting at either end thereof to allow for convenient access to an exerciser while remaining on the exercise machine 12.

The self-standing weighted pole system 10 may be utilized with respect to various types of exercise machines 12 or without an exercise machine 12. One example of an exercise machine 12 is a Pilates machine that has a moving carriage the user positions their body upon during exercises. It is generally not recommended to stand upon a Pilates machine because of the inherent instability to an exercise with the moving carriage. As illustrated in FIG. 1, the self-standing weighted pole system 10 allows an exerciser to stand upon the movable carriage of a Pilates machine to perform additional exercises which could not have been safely performed without the self-standing weighted pole system 10. U.S. Pat. Nos. 7,803,095 and 8,641,585 to Sebastien Lagree both disclose an exemplary exercise machines 12 suitable for Pilates exercises and additional exercises with the self-standing weighted pole system 10.

B. Pole

Figure 3:
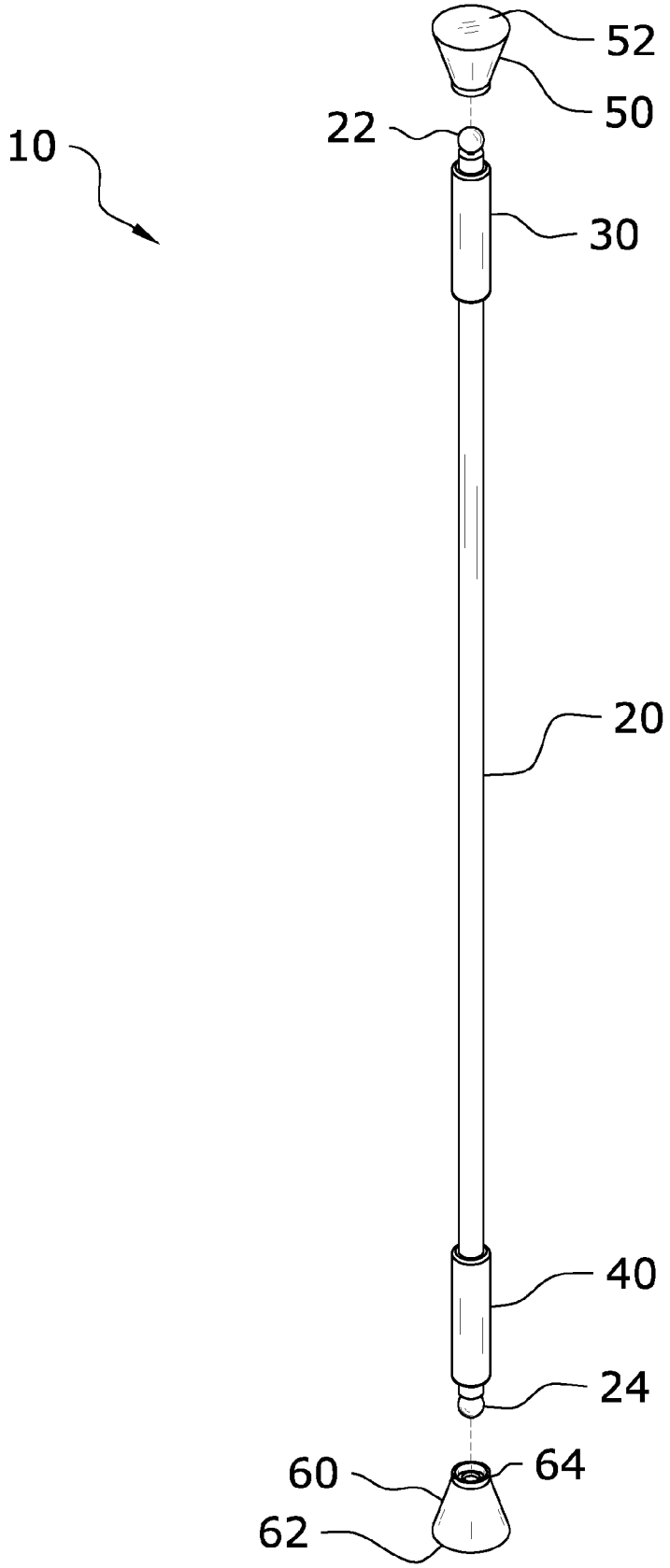
FIG. 3 is an exploded upper perspective view of the present invention.

The pole 20 is an elongated structure having a first end 22 and a second end 24 opposite of the first end 22 as illustrated in FIG. 3 of the drawings. The terms first end 22 and second end 24 as used herein may each represent an upper end or a lower end for the pole 20 based upon the rotational position of the pole 20 by the user. In addition, during exercises, the first end 22 and the second end 24 along with the pole 20 may be horizontally aligned parallel or at a slight angle with respect to the floor 14.

Figure 4:
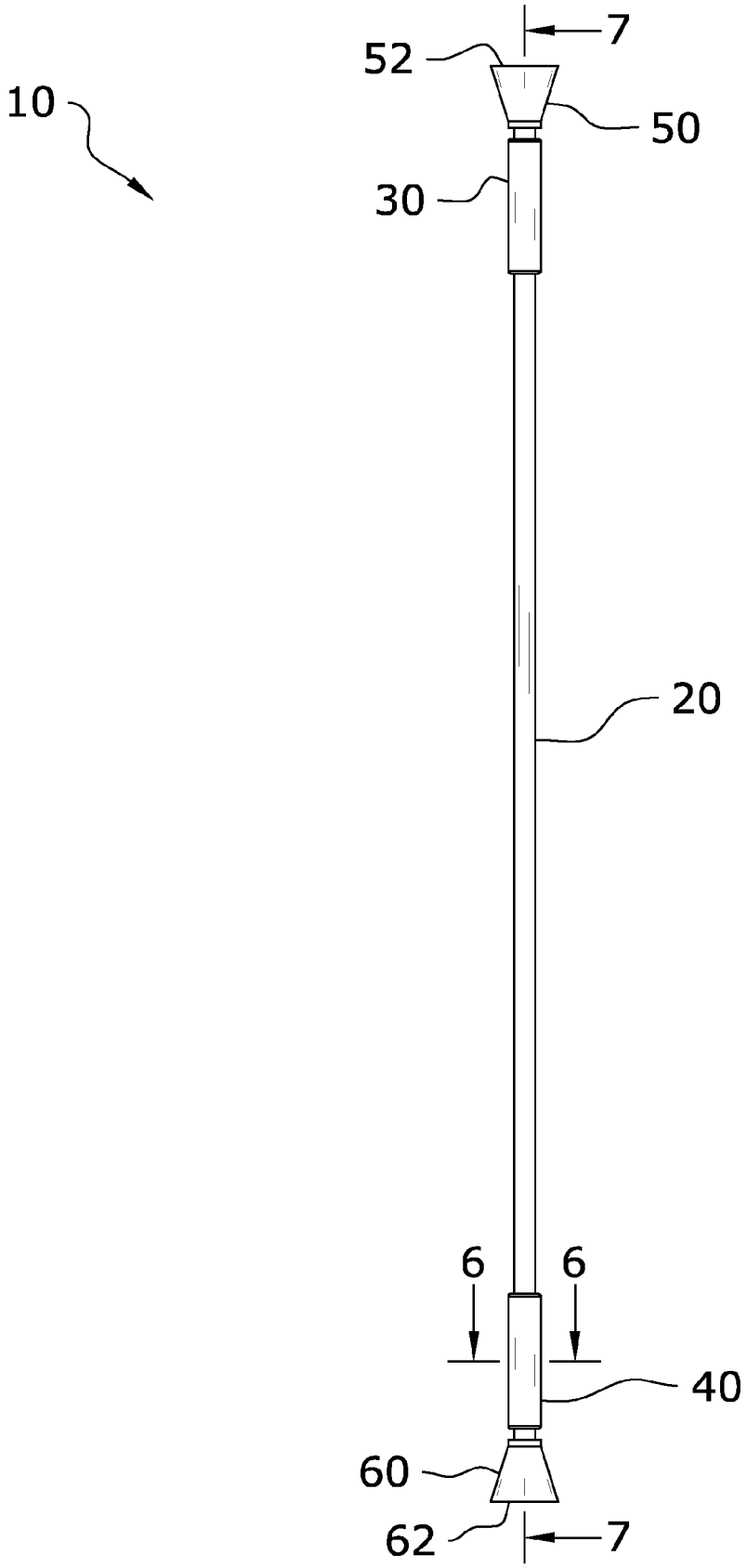
FIG. 4 is a side view of the present invention.
Figure 6:
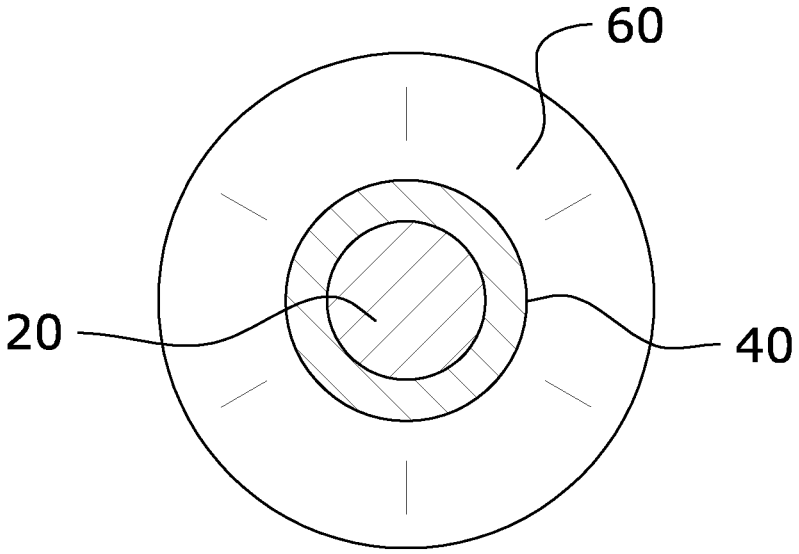
FIG. 6 is a cross sectional view taken along line 6-6 of FIG. 4.

The pole 20 is preferably a straight structure as illustrated in FIG. 4 of the drawings, however, non-straight structures (e.g. curved) may be used for the pole 20. The pole 20 may have various cross sectional shapes such as, but not limited to, circular, rectangular, square, triangular and the like. The width of the pole 20 is narrow enough to allow for comfortable gripping of the pole 20 by most users with their hands. For example, if the pole 20 has a circular cross sectional shape as illustrated in FIG. 6 of the drawings, the pole 20 may have a diameter of approximately 1 inch to 2 inches.

The pole 20 may be comprised of a hollow tubular structure or a solid structure. In addition, the pole 20 may be constructed of one or more materials such as, but not limited to, metal, plastic, composite, carbon fiber and the like.

The pole 20 preferably has a weight of between 5 pounds to 10 pounds to provide additional weight and stability to the present invention for use during exercises. It can be appreciated that the weight may be less than 5 pounds or greater than 10 pounds. It is preferable that the entire self-standing weighted pole system 10 including the pole 20, the first base 50 and the second base 60 weighs approximately 6 pounds.

Conventional Pilates machines typically have a slidable carriage that is positioned approximately 16 inches above the floor 14. When the present invention is to be utilized upon an exercise machine 12 such as a Pilates machine, the length of the self-standing weighted pole system 10 is preferably between 50 inches to 54 inches to help accommodate for the height of the exercise machine 12. The distance from the first outer end 52 of the first base 50 to the second outer end 62 of the second base 60 is preferably between 50 inches to 54 inches. When the present invention is utilized for a Pilates studio with a plurality of Pilates machines, it is preferable that the length of the pole 20 be short enough to prevent the pole 20 of one exerciser from engaging the pole 20 of a nearby exerciser. Furthermore, when the pole 20 is in a vertical position supported upon the floor 14 by the base 50, 60, the upper portion of the pole 20 is preferably at a height that is easily reachable by an exerciser with a substantially horizontally outstretched arm thereby not requiring the exerciser to reach downwardly or upwardly thereby maintaining a secure point of balancing support.

C. First Base

The first base 50 is attached to the first end 22 of the pole 20. The first base 50 may be permanently attached or removably attached to the first end 22 of the pole 20. The first base 50 is adapted to support the pole 20 in a substantially vertically orientated self-standing manner when positioned upon a floor 14 or other surface. The first base 50 may be comprised of various types materials such as, but not limited to, plastic, metal, composite, carbon fiber and the like. The first base 50 may be comprised of a hollow structure or a solid structure.

Figure 7A:
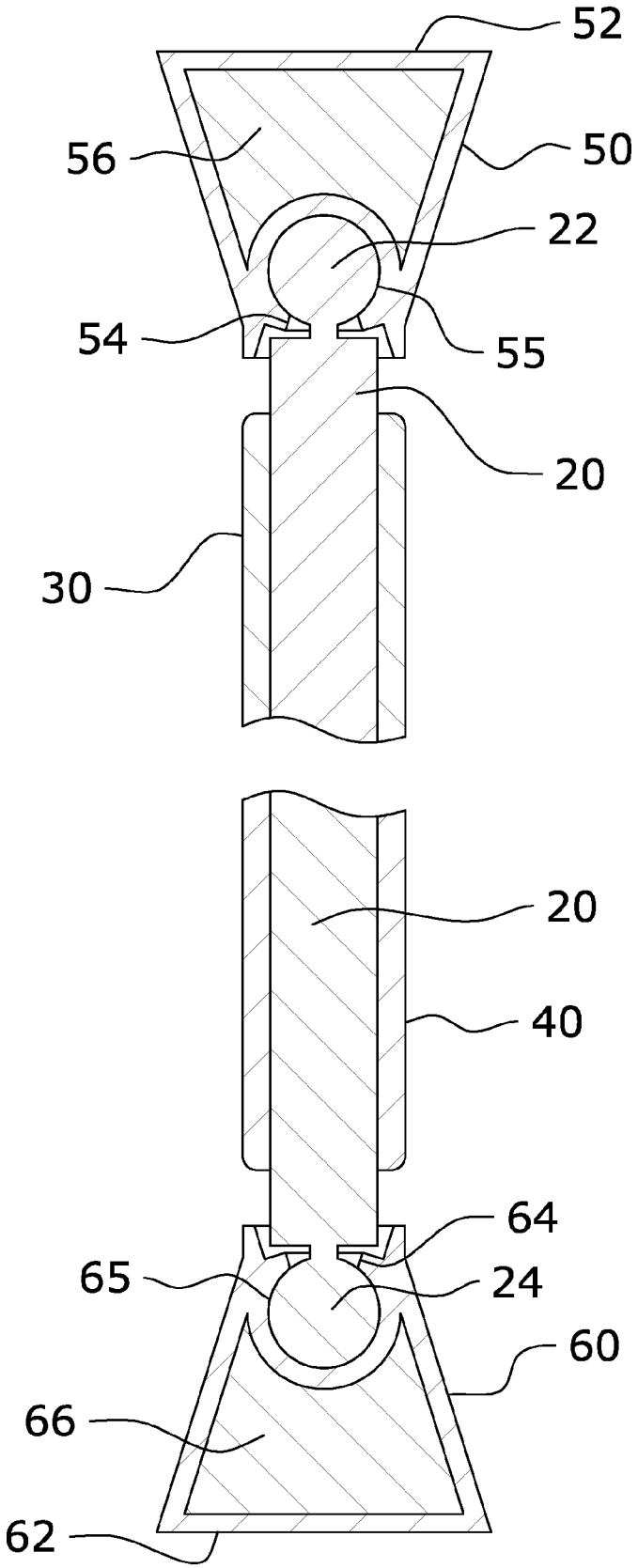
FIG. 7*a* is a cross sectional view taken along line 7-7 of FIG. 4.
Figure 7B:
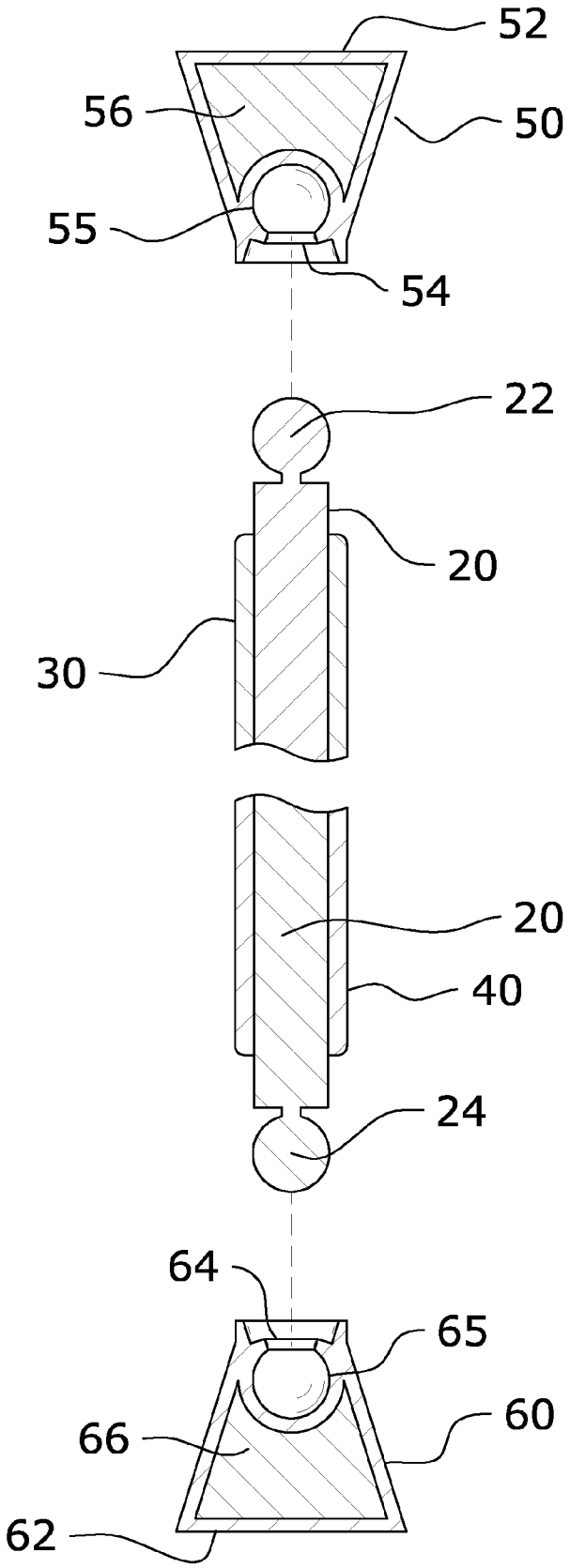
FIG. 7*b* is an exploded view of FIG. 7*a*.

The first base 50 includes a first outer end 52 that is broader than the pole 20 as illustrated in FIGS. 4, 7*a* and 7*b* of the drawings. The first outer end 52 of the first base 50 is preferably a flat surface. As illustrated in FIGS. 7*a* and 7*b* of the drawings, the width of the first outer end 52 is preferably at least two times the width of the pole 20 to provide sufficient support to maintain the pole 20 in a substantially vertically aligned manner. The first base 50 is preferably concentrically aligned with the pole 20 to evenly distribute the weight of the pole 20 via the first base 50.

The first outer end 52 is preferably flat and transverse with respect to a longitudinal axis of the pole 20. The first outer end 52 is adapted to engage the upper surface of the floor 14 or other structure to support the pole 20 in a vertical manner. The first outer end 52 frictionally engages the floor 14 to prevent movement of the first base 50 when a user is utilizing the pole 20 for support during an exercise. The first outer end 52 may be a solid end or a hollow end structure. The first outer end 52 of the base may also include a gripping material (e.g. rubber) to increase the frictional engagement of the first outer end 52 with the floor 14.

Figure 10:
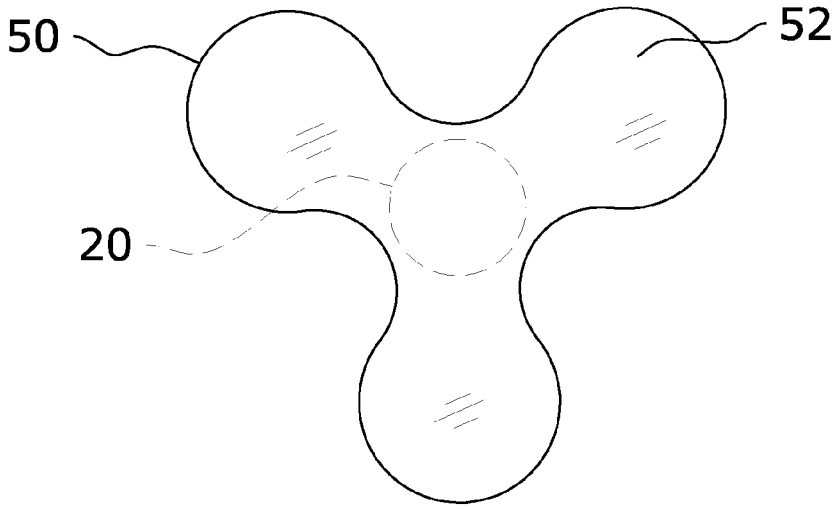
FIG. 10 is an end view of the base having a first alternative shape.
Figure 11:
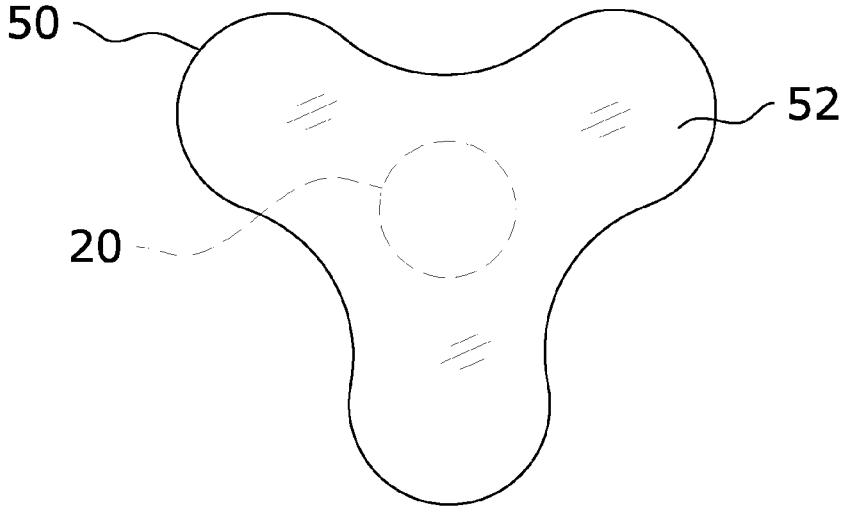
FIG. 11 is an end view of the base having a second alternative shape.
Figure 13:
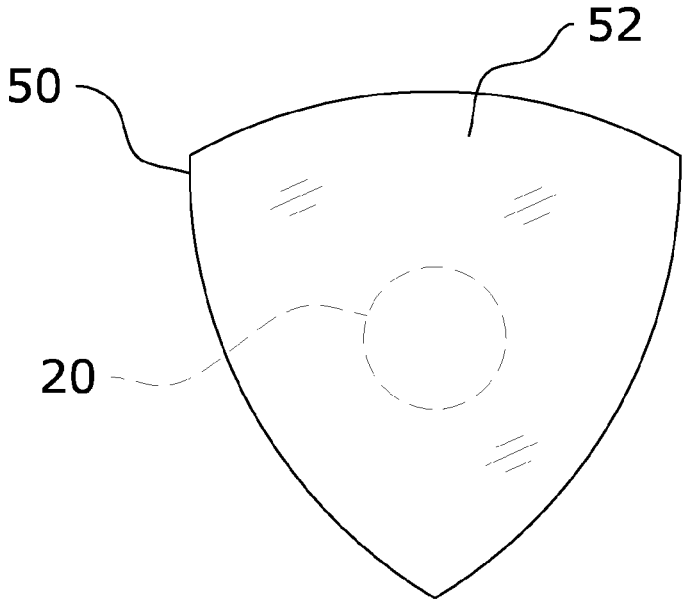
FIG. 13 is an end view of the base having a fourth alternative shape.

The first base 50 preferably tapers inwardly from the first outer end 52 towards the pole 20 whereby the inner end of the of the first base 50 is significantly narrower than the first outer end 52. FIGS. 1 through 9 illustrate the first base 50 preferably has a conical structure tapering inwardly from the first outer end 52 to the pole 20. The first base 50 may have other shapes and structures (e.g. a cube structure). The first outer end 52 is preferably circular shaped, but may have various other shapes as illustrated in FIGS. 10, 11 and 13.

The first base 50 has a weight that is additional to the weight of the pole 20 thereby changing the total weight and balance of the self-standing weighted pole system 10. The first base 50 is preferably removably connected to the first end 22 of the pole 20 to allow the user to change the weight (e.g. 1 pound, 2 pounds, etc.), shape (e.g. conical, cubical, cylindrical, etc.), structure (e.g. hollow, solid), and/or material type (e.g. plastic, rubber, composite, etc.) of the first base 50 attached to the pole 20.

FIGS. 7*a* and 7*b* of the drawings illustrate the first base 50 having a first weight 56. The first weight 56 is illustrated as being encapsulated within the first base 50, however, the first weight 56 may be exposed from the first base 50. The first weight 56 may be comprised of various materials such as metal.

D. Second Base

Figure 2:
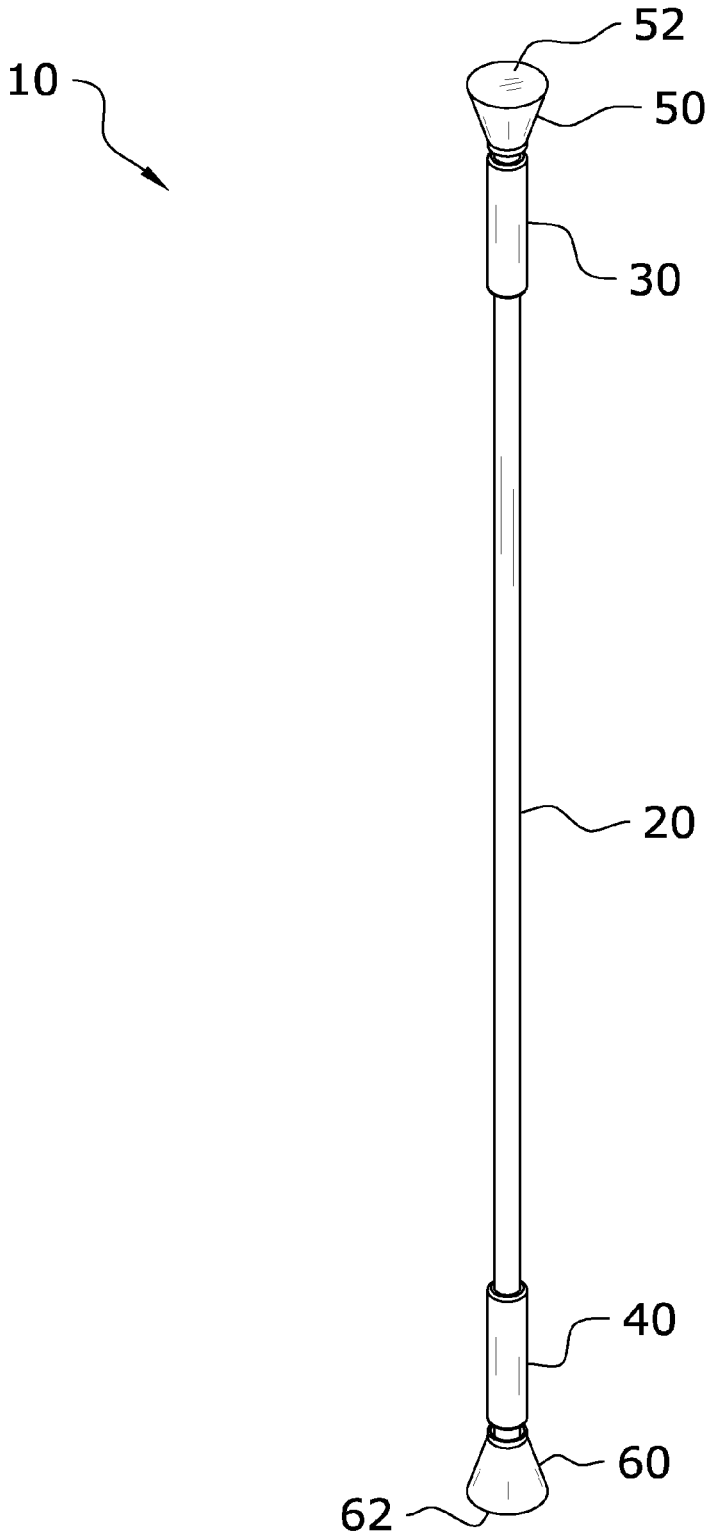
FIG. 2 is an upper perspective view of the present invention.

The second base 60 is attached to the second end 24 of the pole 20 opposite of the first base 50 as illustrated in FIGS. 2 and 4 of the drawings. The second base 60 preferably mirrors the shape, size and structure of the first base 50 as illustrated in FIGS. 2 through 4 of the drawings.

The second base 60 may be permanently attached or removably attached to the second end 24 of the pole 20. The second base 60 is adapted to support the pole 20 in a substantially vertically orientated self-standing manner when positioned upon a floor 14 or other surface. The second base 60 may be comprised of various types materials such as, but not limited to, plastic, metal, composite, carbon fiber and the like. The second base 60 may be comprised of a hollow structure or a solid structure.

The second base 60 includes a second outer end 62 that is broader than the pole 20 as illustrated in FIGS. 4, 7*a* and 7*b* of the drawings. The second outer end 62 of the second base 60 is preferably a flat surface. As illustrated in FIGS. 7*a* and 7*b* of the drawings, the width of the second outer end 62 is preferably at least two times the width of the pole 20 to provide sufficient support to maintain the pole 20 in a substantially vertically aligned manner. The second base 60 is preferably concentrically aligned with the pole 20 to evenly distribute the weight of the pole 20 via the second base 60.

The second outer end 62 is preferably flat and transverse with respect to a longitudinal axis of the pole 20. The second outer end 62 is adapted to engage the upper surface of the floor 14 or other structure to support the pole 20 in a vertical manner. The second outer end 62 frictionally engages the floor 14 to prevent movement of the second base 60 when a user is utilizing the pole 20 for support during an exercise. The second outer end 62 may be a solid end or a hollow end structure. The second outer end 62 of the base may also include a gripping material (e.g. rubber) to increase the frictional engagement of the second outer end 62 with the floor 14.

The second base 60 preferably tapers inwardly from the second outer end 62 towards the pole 20 whereby the inner end of the of the second base 60 is significantly narrower than the second outer end 62. FIGS. 1 through 9 illustrate the second base 60 preferably has a conical structure tapering inwardly from the second outer end 62 to the pole 20. The second base 60 may have other shapes and structures (e.g. a cube structure). The second outer end 62 is preferably circular shaped, but may have various other shapes as illustrated in FIGS. 10, 11 and 13.

The second base 60 has a weight that is additional to the weight of the pole 20 thereby changing the total weight and balance of the self-standing weighted pole system 10. The second base 60 is preferably removably connected to the second end 24 of the pole 20 to allow the user to change the weight (e.g. 1 pound, 2 pounds, etc.), shape (e.g. conical, cubical, cylindrical, etc.), structure (e.g. hollow, solid), and/or material type (e.g. plastic, rubber, composite, etc.) of the second base 60 attached to the pole 20.

FIGS. 7*a* and 7*b* of the drawings illustrate the second base 60 having a second weight 66. The second weight 66 is illustrated as being encapsulated within the second base 60, however, the second weight 66 may be exposed from the second base 60. The second weight 66 may be comprised of various materials such as metal.

Figure 12:
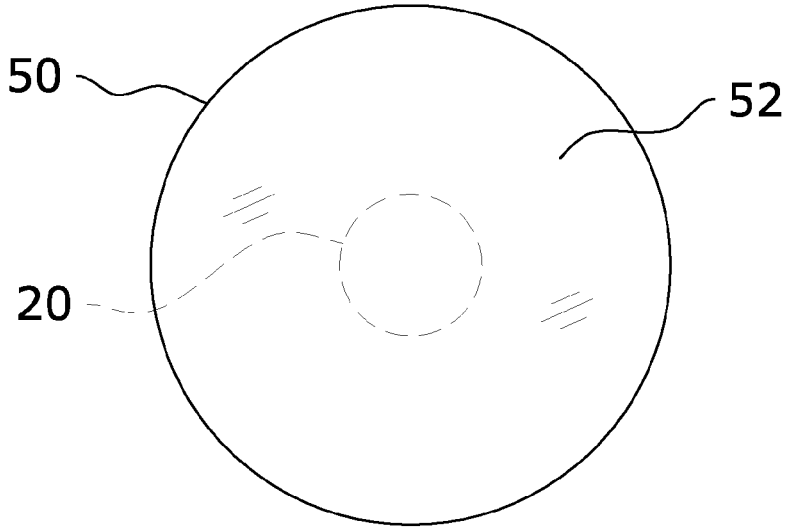
FIG. 12 is an end view of the base having a third alternative shape.

The first outer end 52 of the first base 50 is preferably parallel with respect to the second outer end 62 of the second base 60 as illustrated in FIGS. 4, 7*a* and 7*b* of the drawings. The outer ends 52, 62 of the bases 50, 60 may have various shapes and sizes. FIGS. 10 through 13 of the drawings illustrate example shapes for the first outer end 52 of the first base 50 which may also be used for the second outer end 62 of the second base 60. FIGS. 10 and 11 illustrate several variations of the first outer end 52 having three substantially equal lobes positioned at approximately 120 degrees from one another with the center of each lobe being equidistant from the center of the first base 50 and sufficiently spaced so as to provide a first base 50 that is stable enough to support the pole 20 in a vertical manner. FIG. 12 illustrates the first outer end 52 having a circular shape. FIG. 13 illustrates a first outer end 52 having a triangular shape with the three sides comprised of convex arcs between the three corners. Various other shapes for the first outer end 52 and the second outer end 62 may be used such as square, rectangular, triangular, oval and the like.

E. Connecting Joints

Figure 5:
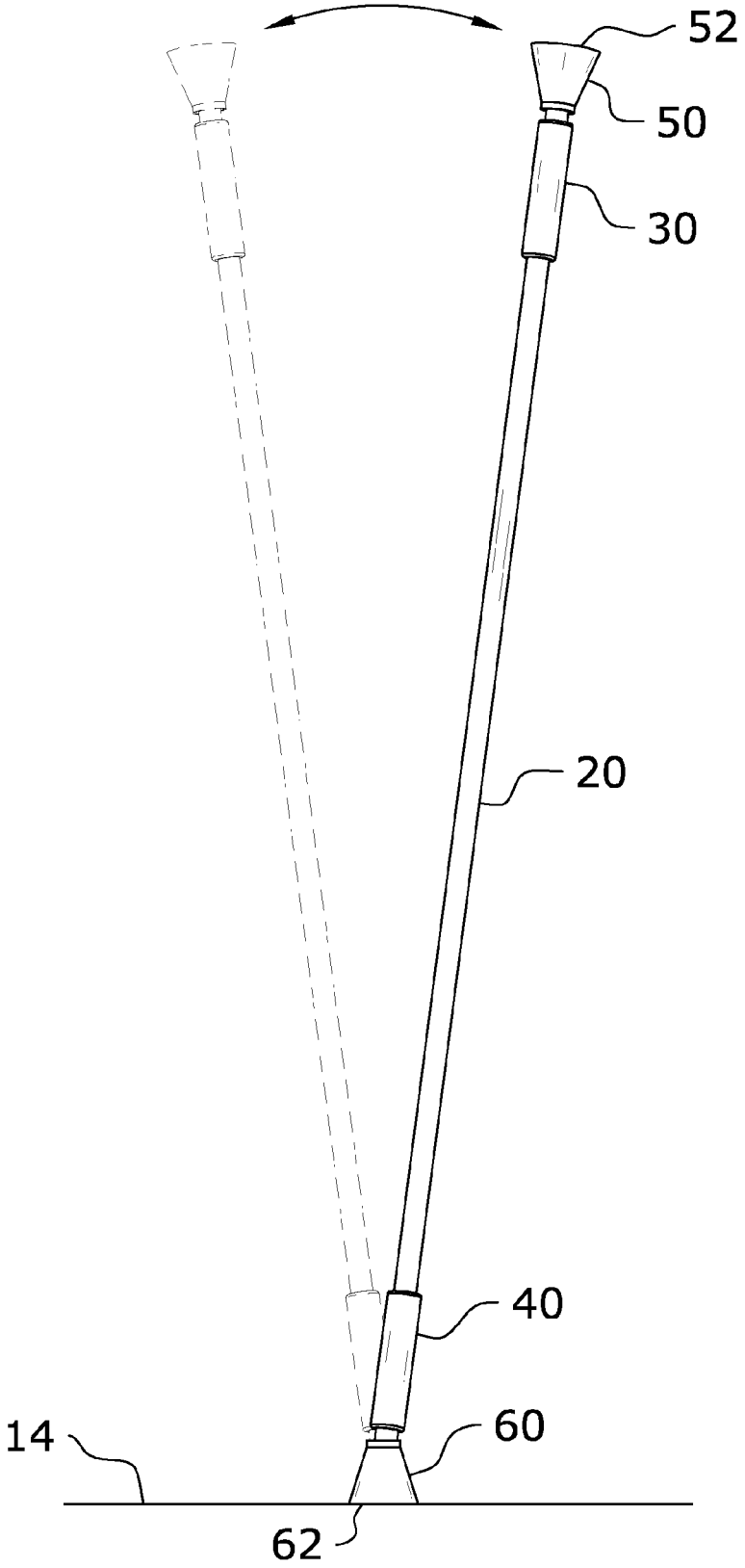
FIG. 5 is a side view of the present invention pivoted into an angled position.

The first base 50 and the second base 60 may be non-movably connected to the pole 20. However, it is preferable that the first base 50 and/or the second base 60 are movably connected to the ends 22, 24 of the pole 20 to allow for a change in the attitude of the pole 20 with respect to the base 50, 60 that is engaging the surface of the floor 14 as illustrated in FIGS. 5 and 9 of the drawings. It is preferable that the bases 50, 60 are pivotally connected to the respective ends 22, 24 of the pole 20 thereby allowing the upper end of the pole 20 to move from side-to-side, outwardly-to-inwardly and the like along various aligned horizontal axes. It is preferable that a biasing force is applied to the pole 20 to maintain a centered and substantially perpendicular alignment with respect to the outer ends 52, 62.

Various types of connecting joints may be used to movably connect the bases 50, 60 to the ends 22, 24 of the pole 20. One type of a connecting joint suitable for usage in the present invention is a ball and socket joint. FIGS. 3, 7*a* and 7*b* of the drawings illustrate the usage of a ball and socket joint with the first end 22 of the pole 20 comprised of a first ball that is removably received within a first socket 55 via a first opening 54 in the first base 50 and the second end 24 comprised of a second ball that is removably received within a second socket 65 via a second opening 64 in the second base 60. As can be appreciated the bases 50, 60 may have the balls and the pole 20 has the sockets. It is further preferable that the ends 22, 24 are removable and interchangeable with the sockets 55, 65 to allow for changing the bases 50, 60. The bases 50, 60 are preferably constructed of a deformable resilient material that allows the pole 20 to articulate and move from the upright vertical position when used. The deformable inner walls of the bases 50, 60 are preferably formed with an inner wall that snugly fits around the perimeter of the end 22, 24 of the pole 20, thereby biasing the pole 20 to assume a straight and upright position centered above the center of the outer ends 52, 62 when unused.

Figure 8:
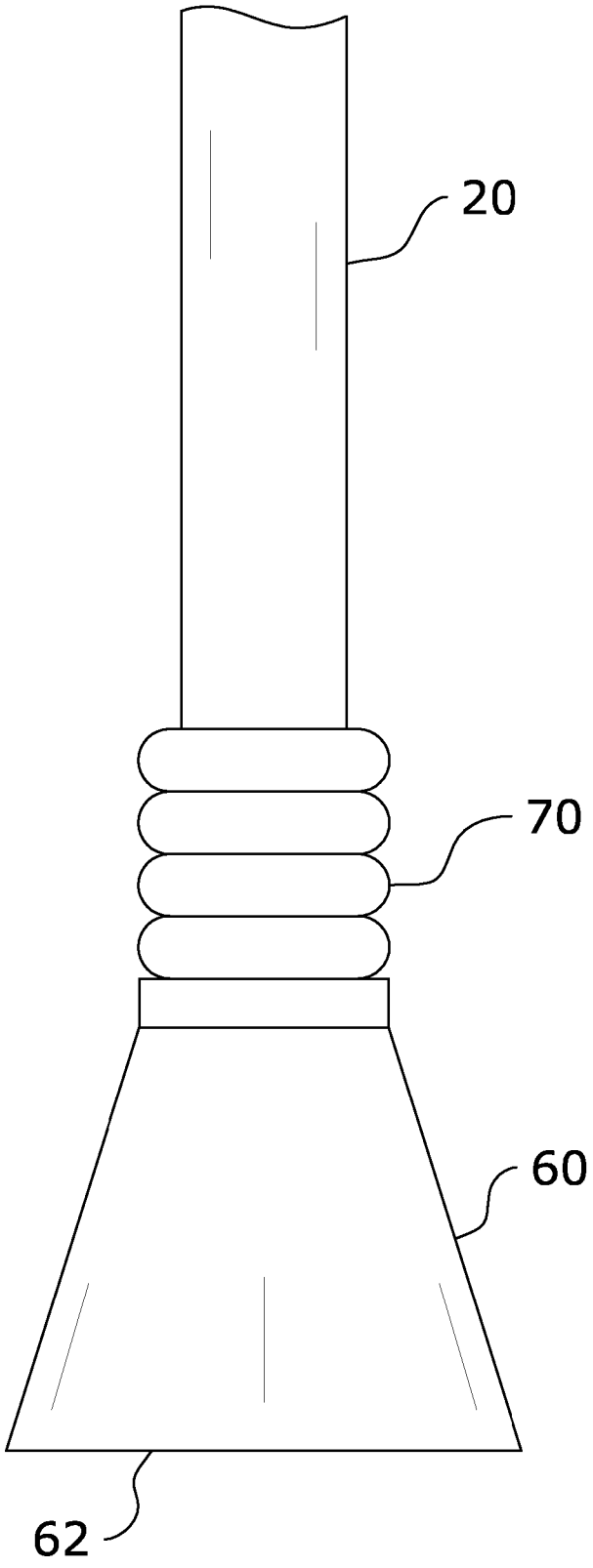
FIG. 8 is a side view of a flexible joint used between the pole and the base.
Figure 9:
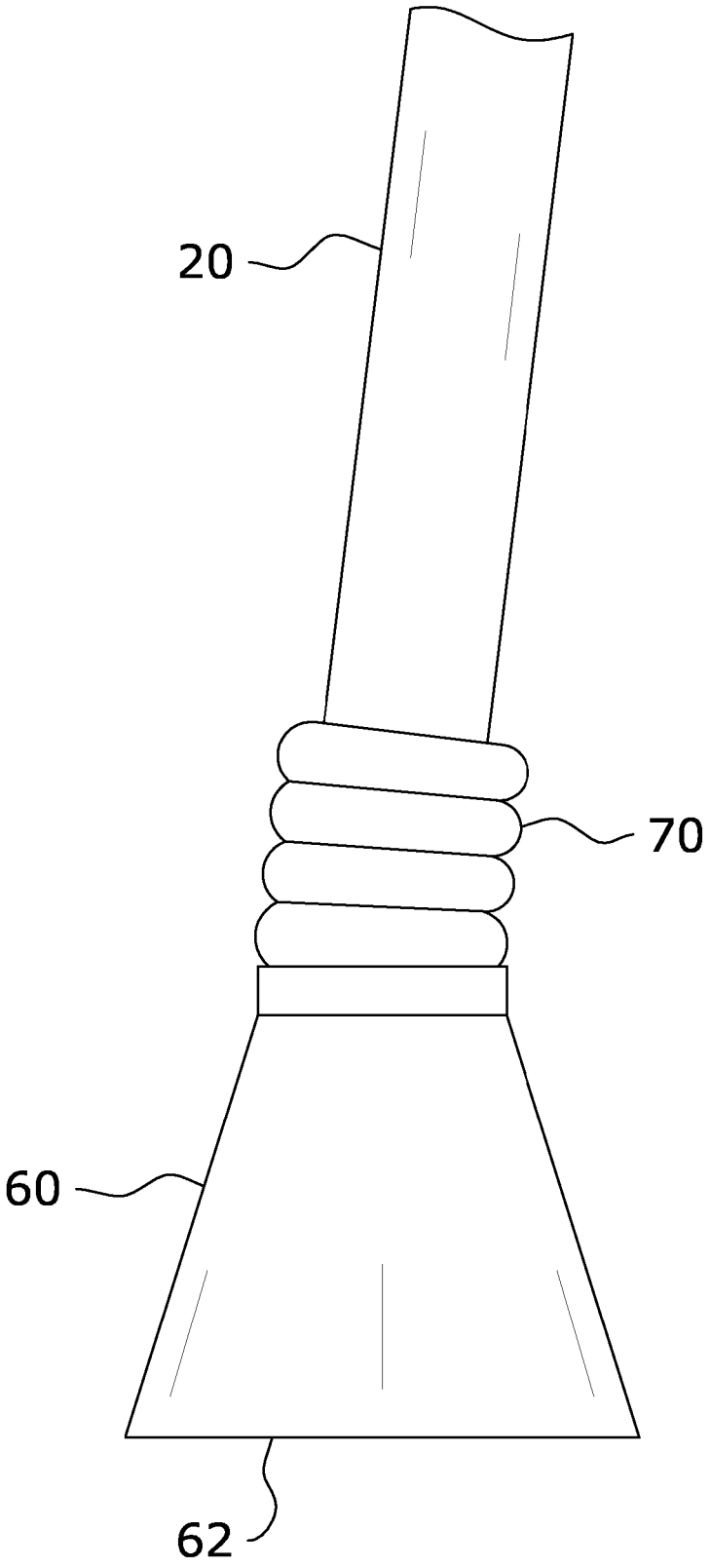
FIG. 9 is a side view of the pole pivoted with respect to the base via the flexible joint.

Another type of connecting joint suitable for the present invention is a flexible joint 70 as illustrated in FIGS. 8 and 9 of the drawings. The flexible joint 70 is comprised of a material or structure that is flexible and resilient to maintain the bases 50, 60 concentrically aligned with the pole 20 while allowing for angular movement of the pole 20 with respect to the bases positioned upon a floor 14 during an exercise as illustrated in FIG. 9. The flexible joint 70 may be comprised of a spring or a flexible plastic material. The flexible joint 70 is comprised of a resilient structure that applies a biasing force to the pole 20 to maintain a substantially vertical position with respect to a floor 14 when the first base 50 is positioned upon the floor 14.

It should be noted that the two articulation means previously described are not meant to be limiting, and any number of alternate articulation means can be used to ensure that the maximum surface area of the outer ends 52, 62 of the bases 50, 60 remain substantially in frictional contact with the floor 14 during use. For example, a separate intermediary component such as a deformable elastomer or compression spring may be inserted between and affixed to the pole 20 and bases 50, 60, and the elastomer or compression spring may be affixed to the interior or exterior of the ends 22, 24 of the pole 20. Regardless of the means used to provide articulation between the bases 50, 60 and the pole 20, it can be appreciated that the means preferably biases the pole 20 back to an upright position, with a center of gravity substantially centered over the bases 50, 60 so as to allow the pole 20 to stand upright and unsupported upon the outer ends 52, 62 when not in use.

F. Gripping Sleeves

FIGS. 1 through 5 illustrate a first gripping sleeve 30 positioned upon the pole 20 near the first end 22 of the pole 20 and a second gripping sleeve 40 positioned upon the pole 20 near the second end 24 of the pole 20. The gripping sleeves 30, 40 are tubular and attached to the pole 20 in a non-movable manner so that a user grasping the gripping sleeves 30, 40 is able to firmly engage the pole 20 in a non-slipping manner with their hands. The gripping sleeves 30, 40 are optional and not required for usage of the invention.

The gripping sleeves 30, 40 are comprised of a material that is easily grasped and frictionally engaged by a user with their hands. The gripping sleeves 30, 40 may be comprised of a resilient material such as rubber, foam rubber and the like. The length of the gripping sleeves are sufficient to allow for all of the fingers of the user to engage the respective gripping sleeve 30, 40 as illustrated in FIG. 1 of the drawings. The thickness of the gripping sleeves 30, 40 may vary and the shape of the gripping sleeves 30, 40 may be ergonomically shaped. The gripping sleeves 30, 40 may also be comprised of a coating applied to the outer surface of the pole 20. Alternatively, knurling or other surface texturing upon the outer surface of the pole 20 may be used instead of the gripping sleeves 30, 40.

G. Operation of Preferred Embodiment

Before being grasped by the exerciser, the pole 20 is standing upright, balanced upon the first outer end 52 (or the second outer end 62) upon a substantially horizontal surface such as a floor 14. Upon grasping the upper portion of the pole 20, the exerciser pulls the pole 20 toward their body and transfers some of their body weight to the pole 20, thereby pushing the pole 20 down towards the floor 14 as a balancing means. With the exerciser's weight pushing the pole 20 towards the floor 14 surface, the lower surface of the first outer end 52 exhibits a high coefficient of friction with the surface of the floor 14, the lower end of the pole 20 is thereby temporarily anchored balancing pole 20 to a point on the floor 14. The exerciser may instantly change the position of the pole 20 by lifting it from the floor 14 and replacing is at a different location upon the floor 14, thereby re-anchoring the first outer end 52 to the floor 14 for balancing by pressing the pole 20 towards the floor 14.

When the pole 20 is grasped by an exerciser upon a Pilates apparatus and pulled angularly towards them as a balancing support, a portion of the flat surface of the first outer end 52 of the first base 50 (or the second outer end 62 of the second base 60) will be lifted from the floor 14, thereby reducing the frictional contact surface area between the first outer end 52 and the floor 14. The reduction of surface contact area could result in the first base 50 (or the second base 60) of the pole 20 slipping away from the exerciser when a substantially downward force is applied to the pole 20. Therefore, it is preferable that the first base 50 articulate relative to the pole 20 such that the entire frictional surface of the first outer end 52 remains substantially in full contact with the floor 14 at all times while being used by the exerciser.

When used by the exerciser, with the first outer end 52 being temporarily anchored to the floor 14 by a frictional means, the pole 20 will articulate about the ball and socket joint in response to the exerciser's movement of the upper end of the pole 20, thereby providing that the lower surface of the base end being in frictional contact with the floor 14 surface to remain in contact with the floor 14 surface regardless of the angle on the pole 20 created by the user during an exercise.

When used by an exerciser upon a Pilates apparatus, the upper end of the pole 20 is grasped by the exerciser, and a downward force is applied in order to frictionally secure the lower surface of the first base 50 to the floor 14 as a temporary anchoring point for balancing. As the exerciser moves about the Pilates apparatus while performing an exercise, the upper end of the pole 20 will move relative to the lower end which is the temporarily anchored end of the pole 20.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A self-standing exercise pole, comprising:

a pole having a lower end and an upper end, wherein said pole is comprised of an elongated structure;

a first base pivotally connected to said upper end of said pole, wherein said first base includes an outer end that is broader than said pole, and wherein said first base is adapted to support said pole in a substantially vertically orientated self-standing manner when positioned upon a floor;

a first hand grip attached to said pole near said first base;

a second base attached to said lower end of said pole, wherein said lower end is comprised of a ball and wherein said second base includes a socket that said ball is pivotally positioned within, wherein said second base includes an outer end that is broader than said pole, and wherein said second base is adapted to support said pole in a substantially vertically orientated self-standing manner when positioned upon a floor; and a second hand grip attached to said pole near said second base.

2. The self-standing exercise pole of claim 1, wherein said pole is comprised of a straight structure.

3. The self-standing exercise pole of claim 1, wherein said pole is comprised of a solid structure.

4. The self-standing exercise pole of claim 1, wherein said pole has a weight of between 5 pounds to 10 pounds.

5. The self-standing exercise pole of claim 1, wherein said pole, said first base and said second base have a combined length of between 50 inches to 54 inches.

6. The self-standing exercise pole of claim 1, wherein said first base tapers from said outer end of said first base to said pole.

7. The self-standing exercise pole of claim 1, wherein said first hand grip and said second hand grip are comprised of a gripping sleeve positioned upon said pole.

8. The self-standing exercise pole of claim 1, wherein said second base includes a weight.

9. The self-standing exercise pole of claim 1, wherein said outer end of said second base is comprised of a flat surface.

10. The self-standing exercise pole of claim 1, wherein said outer end of said second base is comprised of a gripping material that is adapted to frictionally engage a floor.

11. A self-standing exercise pole, comprising:

a pole having a first end and a second end, wherein said pole is comprised of an elongated straight structure, wherein said pole has a weight of between 5 pounds to 10 pounds;

a first base pivotally connected to said first end of said pole, wherein said first base includes a first outer end that is broader than said pole, and wherein said first base is adapted to support said pole in a substantially vertically orientated self-standing manner when positioned upon a floor;

a first hand grip attached to said pole near said first base;

a second base attached to said second end of said pole, by a flexible joint, wherein said flexible joint is comprised of a resilient structure that applies a biasing force to said pole to maintain a substantially vertical position with respect to a floor when said second base is positioned upon said floor, wherein said second base includes a second outer end that is broader than said pole, and wherein said second base is adapted to support said pole in a substantially vertically orientated self-standing manner when positioned upon a floor; and a second hand grip attached to said pole near said second base;

wherein said pole, said first base and said second base have a combined a length of between 50 inches to 54 inches;

wherein said first base and said second base are concentrically aligned with said pole;

wherein said first outer end and said second outer end are each flat and transverse with respect to a longitudinal axis of said pole;

wherein said first outer end is substantially parallel with respect to said second outer end.

12. A self-standing exercise pole, comprising:

a pole having a first end and a second end, wherein said pole is comprised of an elongated structure; and a first base attached to said first end of said pole, wherein said first base is comprised of a tapered structure tapering from a first outer end of said first base to said pole, wherein said first outer end of said first base is broader than said pole, and wherein said first base is adapted to support said pole in a substantially vertically orientated self-standing manner when positioned upon a floor;

wherein said first base includes a first weight, wherein said first weight has an outer end and an inner end, wherein said outer end of said first weight is broader than said inner end of said first weight, wherein said outer end of said first weight is broader than said pole, wherein said first weight tapers from said outer end to said inner end of said first weight, and wherein said first weight is conical shaped.

13. The self-standing exercise pole of claim 12, wherein said first outer end is substantially transverse with respect to a longitudinal axis of said pole.

14. The self-standing exercise pole of claim 12, wherein said first weight is encapsulated within said first base.

15. The self-standing exercise pole of claim 12, wherein said first base is removable from said pole.

16. The self-standing exercise pole of claim 12, including a second base attached to said second end of said pole, wherein said second base is comprised of a tapered structure tapering from a second outer end of said second base to said pole, wherein said second outer end of said second base is broader than said pole, and wherein said second base is adapted to support said pole in a substantially vertically orientated self-standing manner when positioned upon a floor.

17. The self-standing exercise pole of claim 16, wherein said second base includes a second weight.

18. A self-standing exercise pole, comprising:

a pole having a lower end and an upper end, wherein said pole is comprised of an elongated structure;

a first base connected to said upper end of said pole, wherein said first base includes an outer end that is broader than said pole, and wherein said first base is adapted to support said pole in a substantially vertically orientated self-standing manner when positioned upon a floor;

a first hand grip attached to said pole near said first base;

a second base;

a flexible joint connecting said second base and said lower end of said pole, wherein said flexible joint is comprised of a resilient structure that applies a biasing force to said pole to maintain a substantially vertical position with respect to a floor when said second base is positioned upon said floor, wherein said second base includes an outer end that is broader than said pole, and wherein said second base is adapted to support said pole in a substantially vertically orientated self-standing manner when positioned upon a floor; and a second hand grip attached to said pole near said second base.

19. The self-standing exercise pole of claim 18, including a second flexible joint connecting said first base to said upper end of said pole.

20. The self-standing exercise pole of claim 18, wherein said flexible joint is comprised of a spring.

21. The self-standing exercise pole of claim 18, wherein said flexible joint is comprised of a flexible plastic material.

22. The self-standing exercise pole of claim 18, wherein said pole is comprised of a straight structure.

23. The self-standing exercise pole of claim 18, wherein said pole is comprised of a solid structure.

24. The self-standing exercise pole of claim 18, wherein said pole has a weight of between 5 pounds to 10 pounds.

25. The self-standing exercise pole of claim 18, wherein said pole, said first base and said second base have a combined length of between 50 inches to 54 inches.

26. The self-standing exercise pole of claim 18, wherein said first base tapers from said outer end of said first base to said pole.

* * * * *